US007311569B2

(12) United States Patent
Mullen et al.

(10) Patent No.: US 7,311,569 B2
(45) Date of Patent: Dec. 25, 2007

(54) MARINE OUTBOARD MOTOR JACK PLATE STOP

(76) Inventors: Sam Mullen, 4115 Medical Dr. #410, San Antonio, TX (US) 78229; Tim Brooks, 14809 FM 1346, St. Hedwig, TX (US) 78152

( * ) Notice: Subject to any disclaimer, the term of this patent is extended or adjusted under 35 U.S.C. 154(b) by 0 days.

(21) Appl. No.: 11/396,825

(22) Filed: Apr. 3, 2006

(65) Prior Publication Data

US 2007/0232160 A1 Oct. 4, 2007

(51) Int. Cl.
*B63H 5/125* (2006.01)

(52) U.S. Cl. ..... 440/55; 440/61 E

(58) Field of Classification Search ..... 440/55, 440/53, 61 T, 61 E
See application file for complete search history.

(56) References Cited

U.S. PATENT DOCUMENTS

| | | | | |
|---|---|---|---|---|
| 4,077,353 | A | 3/1978 | Webb, Jr. | |
| 4,232,627 | A | 11/1980 | Glenn et al. | |
| 4,373,921 | A | 2/1983 | Hall et al. | |
| 4,482,330 | A | 11/1984 | Cook | |
| 4,682,961 | A | 7/1987 | Nakahama | |
| 4,925,410 | A * | 5/1990 | Boda | 440/55 |
| 4,954,107 | A | 9/1990 | Sumigawa | |
| 5,100,349 | A | 3/1992 | Perkins et al. | |
| 5,782,662 | A | 7/1998 | Icenogle | |
| 6,126,498 | A | 10/2000 | Icenogle | |
| 6,227,920 | B1 | 5/2001 | Alby et al. | |
| 6,305,996 | B1 * | 10/2001 | Detwiler | 440/53 |
| 6,409,556 | B1 | 6/2002 | Vance | |
| 6,652,335 | B1 | 11/2003 | Peschmann et al. | |
| 6,890,227 | B1 | 5/2005 | Alby et al. | |
| 2004/0007200 | A1 * | 1/2004 | Kurokawa et al. | 123/198 R |

* cited by examiner

*Primary Examiner*—Sherman Basinger
(74) *Attorney, Agent, or Firm*—Kammer Browning PLLC

(57) ABSTRACT

An easy to use, inexpensive jack plate stop device for insertion into the guide slot of a jack plate to immobilize an outboard motor in raised position is disclosed. An outboard motor is fully raised using the jack plate by way of a hydraulic cylinder; the jack plate stop device is then inserted into the open portion of the guide slot so as to rest on the guide bolt at the bottom of the guide slot. The motor component of the jack plate is lowered slightly in order to fully engage the stop device in the guide slot, thus preventing the motor from dropping further if hydraulic pressure is released. The device may include a handle for ease of insertion and removal from the guide slot. The device may be made of any rigid material having a load-bearing capacity adequate to support the weight of an outboard motor.

11 Claims, 5 Drawing Sheets

MARINE OUTBOARD MOTOR JACK PLATE STOP

BACKGROUND OF THE INVENTION

1. Field of the Invention

The present invention relates generally to a jack plate fastened to the stern of a boat to mount an outboard marine motor. Specifically, the present invention is directed to a rigid bar insert placed in a slot style jack plate in order to restrict vertical movement of an outboard motor when it is in an elevated position, thus securing the motor in position if hydraulic pressure is released.

2. Description of the Related Art

Well known in the prior art are devices designed to assist in vertical movement of a marine outboard motor using a hydraulic jack plate. These designs involve methods of mounting an outboard motor to a boat transom so that the motor can be raised and lowered with a hydraulic cylinder. This movement allows the position of the outboard motor to vary according to boat speed and water depth. Various methods for adjusting the motor height include telescoping tubes, brackets, and sliding plates. Problems inherent in these designs include hydraulic leaks and other instances of lost hydraulic pressure that would cause the motor to drop from the desired height, thus causing motor damage and safety hazards. Unfortunately, such jack plate devices do not typically provide any safety stops to restrict the motor's movement when the motor is in an elevated position. Little effort has been made to provide devices to immobilize these outboard motors. Those devices that are used to restrict the movement of a raised outboard motor are complex in design and of limited functionality.

There are several problems inherent in not having a device to restrict the motion of an outboard motor when it is in an elevated position. The motor can drop unexpectedly, causing injury to the user or to mechanical equipment. For example, the hydraulic pressure in the hydraulic cylinder(s) of a jack plate may decrease, resulting in the motor falling. In addition to safety issues, an outboard motor can be severely damaged during loading, unloading, or traveling if the hydraulic cylinder(s) lose pressure, resulting in expensive motor and/or propeller repair or replacement costs. It would be advantageous to have an inexpensive device which could immobilize an elevated motor during transit or servicing, thus greatly reducing the likelihood of injury and costly repairs.

Thus, there is a need for an inexpensive jack plate stop device to secure a marine outboard motor. Such a device would ideally be simple to use and simple in design, without movable parts to break, thus eliminating the need for repairs. The device should be inexpensive to manufacture and easily replaceable. In comparison to the significant expenses involved in costly motor repairs and replacements, such an inexpensive device would be especially desirable to boat owners. Existing products have been unable to deliver a device which provides all of these benefits.

SUMMARY OF THE INVENTION

The present invention provides a jack plate stop device to immobilize an outboard marine motor mounted on a bolt-in-slot style jack plate. The device consists of a rigid bar that fits securely into the guide slots of the jack plate which is attached between the boat and motor. The stop device is positioned above one of the bolts which are fitted through the jack plate within one of the guide slots. The device ensures that the outboard motor will remain in its raised position in the event that the pressure is released from the hydraulic cylinder (intentionally or unintentionally). In this way, the motor's movement is restricted, thus preventing sudden (or gradual) release and damage. The weight of the motor is removed from the hydraulic lifting cylinder, permitting safe and secure towing, repair, servicing, and storage.

The bar is made of a rigid material such as machined aluminum, high density molded plastic, or any other material having sufficient load-bearing capacity to support the weight of an outboard motor. The bar may be drilled with one or more holes perpendicular to the jack plate slot for the purpose of positioning handling posts, cords, or other gripping means. Alternatively, larger holes may be drilled into the bar to serve as finger holes for gripping rather than holes for insertion of a handle or cord. All of these options for gripping the jack plate stop device are designed to facilitate the insertion and removal of the device in the slot.

The bar is proportioned to fit snugly into the jack plate slot to ensure that it will not fall out during transport and will secure the motor until the insert is removed. The weight of the motor also holds the insert in place. The shape and size of the jack plate slots are set out in industry standards and vary slightly with differing slot style jack plates. The dimensions of the device of the present invention are scaled to match with those slot dimensions for various jack plates in the industry. One end of the insert is convex to fit snugly into the curvature of the upper end of the jack plate slot, while the other end is concave, thus allowing the guide post/bolt to extend into the concavity. This simple sleek design requires minimal machining, thus allowing easy bulk manufacturing with low production costs and a consequently lower purchase price for consumers. The device is easily inserted and removed from the jack plate slot and can be inexpensively replaced if worn, damaged, or lost.

BRIEF DESCRIPTION OF THE DRAWINGS

A more complete understanding of the present invention may be had by reference to the following detailed description taken in conjunction with the accompanying drawings, wherein.

DETAILED DESCRIPTION OF THE PREFERRED EMBODIMENTS

The present invention is related to jack plates fastened to the stern of a boat and used to mount outboard marine motors, specifically slot style jack plates. Specifically, this invention describes a jack plate stop device used to immobilize an outboard marine motor when the motor is raised to its most upright position using the hydraulic cylinder(s) of the jack plate. The device of the present invention is inserted into the guide slot of a slot style jack plate to serve as a safety stop. An example of the type of jack plate for which this insert is designed is the CMC Power Lift manufactured by Cook Machine Company of Duncan, Okla. (described by U.S. Pat. No. 4,482,330). Although there are other types of jack plates, the present invention is directed to a slot type hydraulic jack plate of a design similar to that used by the CMC Power Lift.

Figure 1:
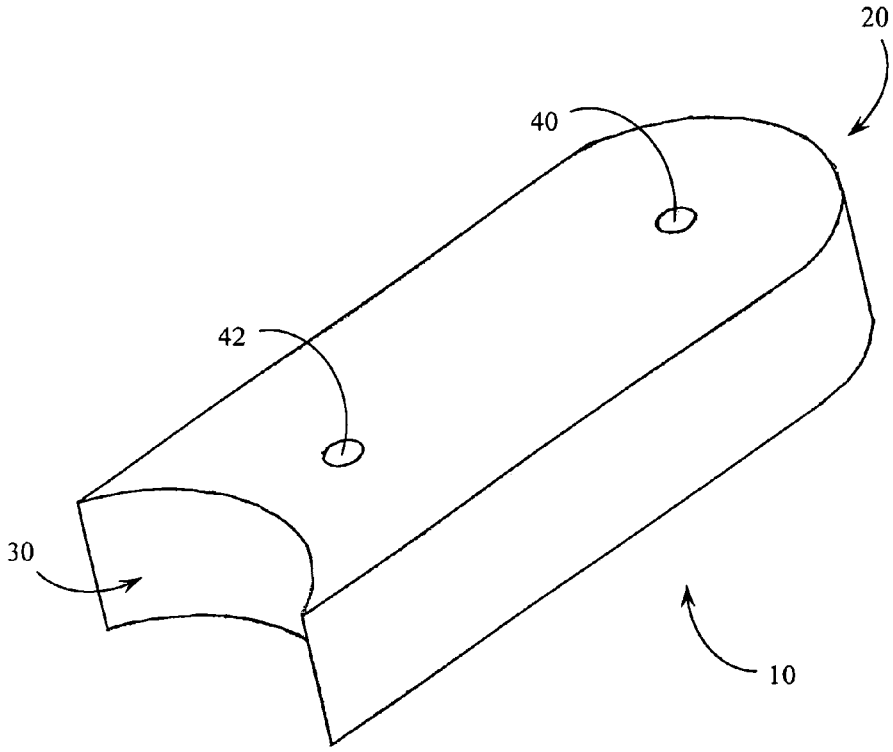
FIG. 1 shows a perspective view of the jack plate stop bar.

As summarized above, the present invention stabilizes an outboard motor when it is raised to its highest position on the jack plate and then is lowered slightly onto the jack plate stop when the jack plate stop has been inserted. The invention prevents the motor from falling if the hydraulic pressure is intentionally or inadvertently released from the hydraulic cylinder. FIG. 1 shows the hydraulic jack plate stop 10 having a convex end 20 and a concave end 30 which each conform and fit into the guide slot of a slot style jack plate. The concave end 30 fits over the guide post/bolt so as to have the guide post/bolt extend into the concavity. The convex end 20 is shaped so as to fit snugly into the upper curvature of the jack plate slot. The conforming design of the jack plate stop allows for easy insertion into and removal from the jack plate slot.

As shown in FIG. 1, two holes 40 and 42 are drilled into the jack plate stop device perpendicular to the jack plate face, one located at either end of the stop device in order to secure a gripping means such as a dowel pin, crossbar handle, or cord. The drilled holes can either be threaded or smooth, depending on the requirements for inserting and securing the gripping means.

Figure 2C:
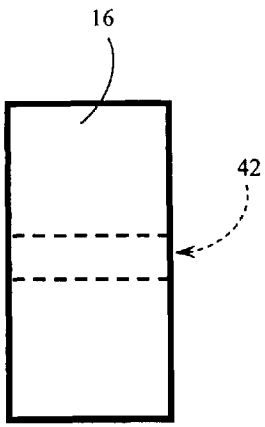
FIG. 2C shows an end elevation view of the jack plate stop bar.
Figure 2B:
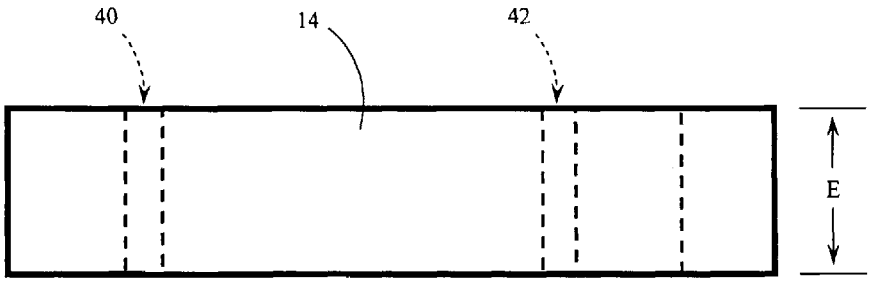
FIG. 2B shows a side elevation view of the jack plate stop bar.
Figure 2A:
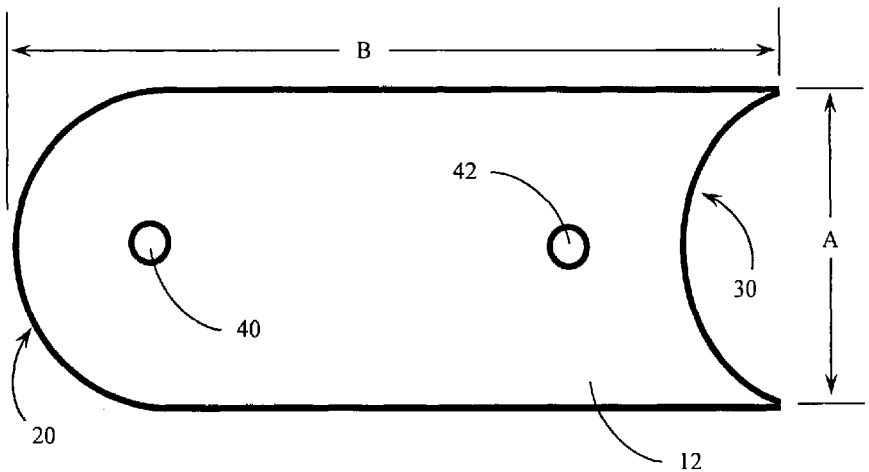
FIG. 2A shows a top elevation view of the jack plate stop bar.

FIGS. 2A, 2B, and 2C illustrate the top, side, and end views of the jack plate stop device, respectively. FIG. 2A shows a top elevational view of the jack plate stop, including the two holes 40, 42 for insertion of gripping means. FIG. 2B shows a side elevational view of the jack plate stop, illustrating the generally rectangular outline of the side profile of the device. FIG. 2C shows the end of the jack plate stop, similarly illustrating the generally rectangular outline (and cross-section) of the end profile of the device.

Figure 4:
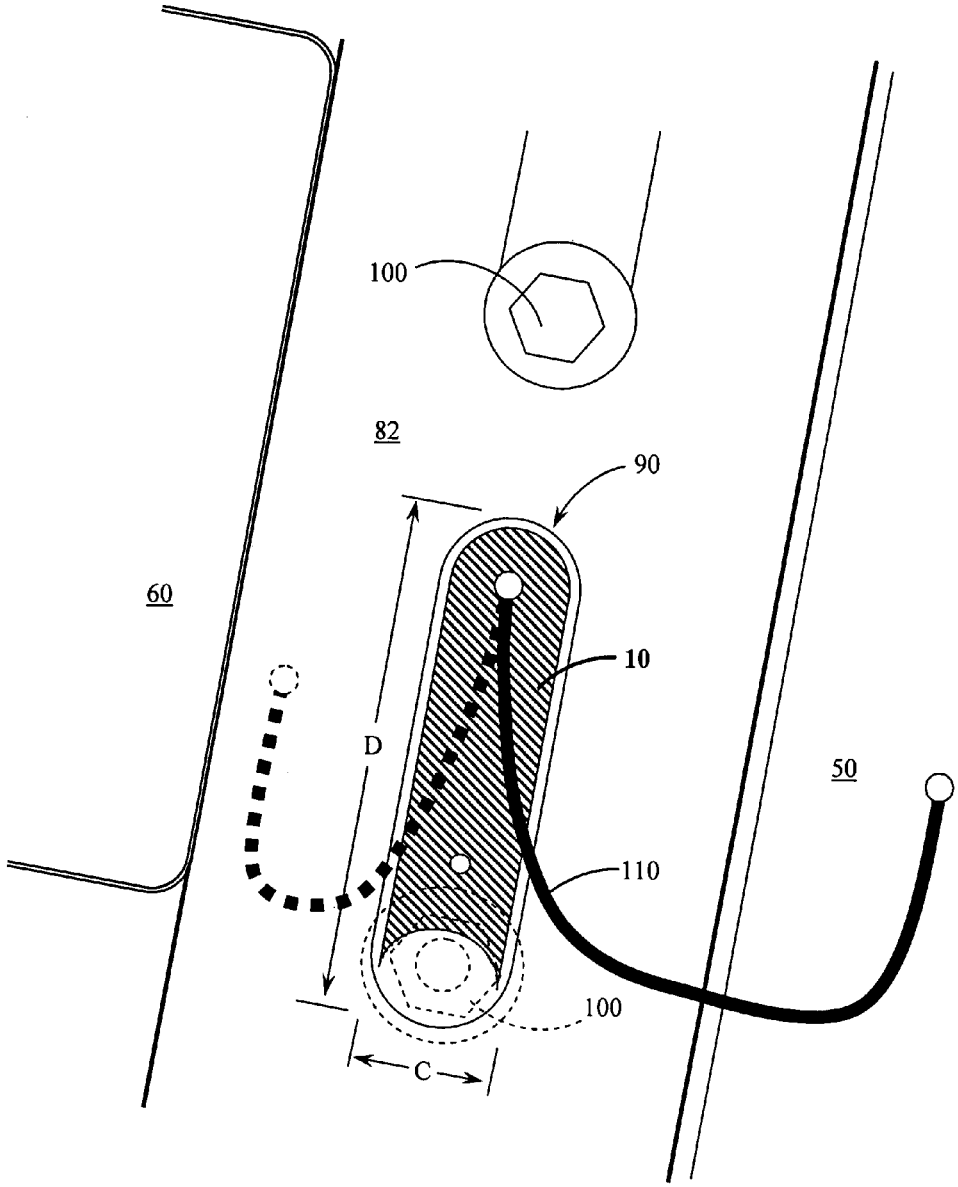
FIG. 4 is a detailed side view of the jack plate stop bar in use.

As shown in FIG. 4, the jack plate stop device is sized to fit into the slot of the jack plate as described above. When the stop device is put into the slot, there is a small degree of clearance. The motor component of the jack plate is then lowered slightly in order to fully engage the stop device. Thus, as shown in FIG. 2A, the width A of the stop is slightly less than the width C (FIG. 4) of the slot in the jack plate, and the length B (FIG. 2A) of the stop is slightly less than the length D (FIG. 4) of the slot in the jack plate. In this way, the jack plate stop fits into the slot of the jack plate snugly, with minimal clearance, once the motor component of the jack plate is slightly lowered. The depth E, as shown in FIG. 2B, of the stop is substantially equal to the clearance between the fixed and hydraulic plates of the jack plate system, so as to securely fit upon the guide post/bolt within the jack plate slot. This well-fitting design, combined with the downward pressure exerted on the stop device once the motor component of the jack plate is slightly lowered, immobilizes the motor, thus safely securing it and reducing the likelihood of injury to the user or to the equipment.

Figure 3:
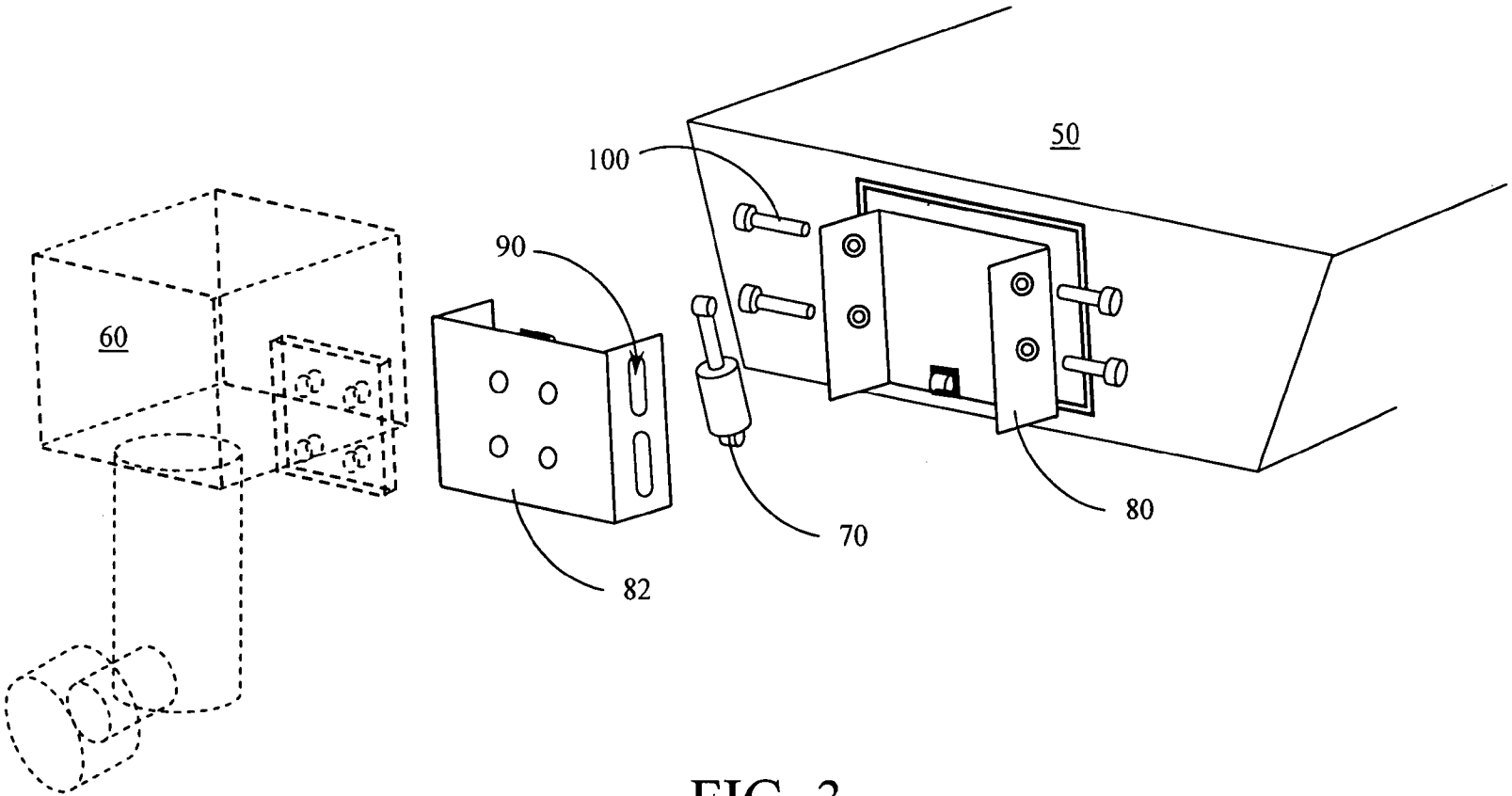
FIG. 3 illustrates an exploded perspective view of a hydraulic jack plate, motor, and boat transom operable in conjunction with the present invention.

FIG. 3 illustrates an exploded perspective view of a hydraulic jack plate, motor, and boat transom operable in conjunction with the present invention. The jack plate comprises two elements, the boat jack plate element 80 which is attached to the stern of the boat 50, and the motor jack plate element 82 which is attached to the housing of the motor 60. When the motor is positioned next to the stern of the boat, the side panels of the jack plate elements 80, 82 overlap. The hydraulic cylinder 70 is positioned in between the jack plate elements 80, 82. The bolt holes on the boat jack plate element 80 are aligned with the slots 90 on the motor jack plate element 82. When the bolts 100 are inserted through the holes and slots and securely fastened, the motor is held in the desired position unless there is a loss of hydraulic pressure or some other mechanical failure of the lift system. The use of the rigid snugly-fitting bar 10 of the present invention in slot 90 of the jack plate immobilizes the motor 60 such that even a loss of hydraulic pressure will not result in the motor dropping unexpectedly.

FIG. 4 illustrates how the device 10 is inserted into the guide slot 90 of the jack plate. The outboard motor 60 is raised to its highest position by elevation of the jack plate by the hydraulic cylinder 70. The motor element of the jack plate is guided along stationary guide bolts 100 that are situated in the jack plate guide slot 90. When the outboard motor 60 is raised to its maximum height, the guide bolt 100 rests at the lowest point of the guide slot 90, thus creating a gap between the top and bottom of the guide slot over the guide bolt.

As shown in FIG. 4, an optional feature of the present invention includes a tether 110 that may extend from jack plate stop 10 (positioned within guide slot 90) to either jack plate element 82 or alternately the structure of the stern of boat 50. Tether 110 serves to prevent excessive separation of the device of the present invention from the boat or the jack plate when the device is not in position in slot 90.

To immobilize the motor, the user inserts the jack plate stop 10 into the guide slot 90 with the drilled holes 40, 42 (or any other gripping or handling device contemplated in alternate embodiments) facing outward. The convex end 20 of the invention fits (loosely at first) at the top of the guide slot 90 while the concave end 30 rests upon the guide bolt 100 behind the bolt head and washer (shown in dashed outlines). The motor element of the jack plate is then lowered (by releasing the hydraulic pressure, for example) which closes the gap between the convex end 20 of the jack plate stop 10 and the top of the guide slot 90 so as to secure the stop 10 in the slot 90 and insure that the motor will not further move from its raised position. This short lowering also provides the downward force sufficient to retain the stop 10 within the slot 90 (by frictional contact).

Figure 5A:
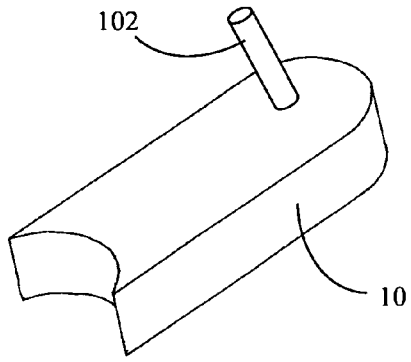
FIG. 5A shows a detail view of the jack plate stop bar with a dowel handle.
Figure 5B:
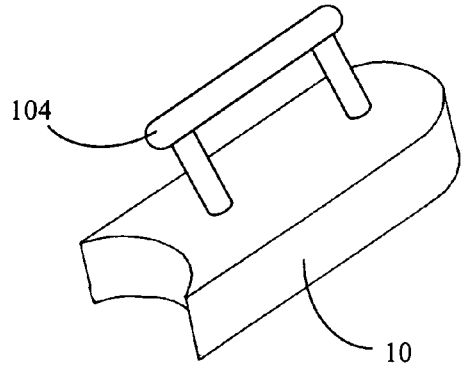
FIG. 5B shows a detail view of the jack plate stop bar with a crossbar handle.
Figure 5C:
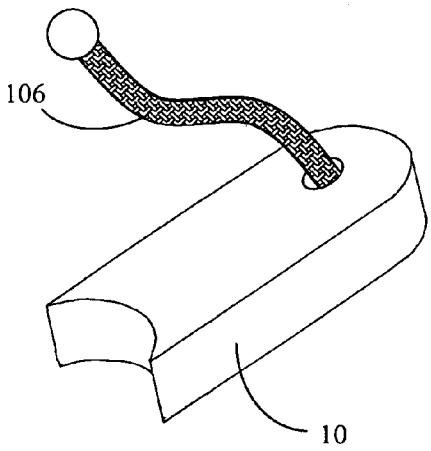
FIG. 5C shows a detail view of the jack plate stop bar with a cord handle.
Figure 5D:
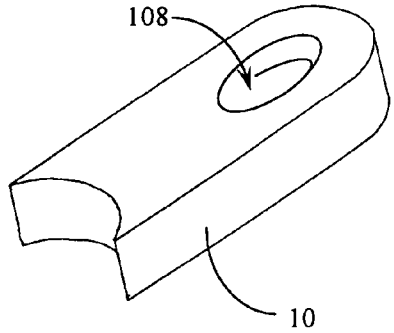
FIG. 5D shows a detail view of the jack plate stop bar with a finger grip handle.

FIGS. 5A, 5B, 5C, and 5D illustrate alternate embodiments which utilize various gripping means that are attached to the jack plate stop at one or more holes drilled into the bar. These various handle embodiments include a dowel pin 102 as shown in FIG. 5A, a crossbar or "U"-shaped handle 104 as shown in FIG. 5B, or a rope cord 106 as shown in FIG. 5C. These drilled holes can be threaded or smooth-bored depending on the gripping means chosen. With a gripping handle attached to the bar, the jack plate stop is inserted into the jack plate guide slot with the handle facing outward for easy removal of the stop. Alternatively, the jack plate stop may have one or more somewhat larger holes 108 drilled into the bar as shown in FIG. 5D to be used as finger grips for ease of bar removal.

In general, the present invention provides an easy to use, inexpensive jack plate stop device which immobilizes an outboard motor in an elevated position when the bar is inserted into the guide slot of the jack plate. When the bar is properly inserted, the motor is prevented from descending if the hydraulic pressure is released. It is anticipated that further variations in the structure of the device will be apparent to those skilled in the art from the present disclosure and the attached drawing figures. Such variations, while not explicitly described and defined herein, may be seen to fall within the spirit and scope of the present invention.

We claim:

1. An apparatus for immobilizing a hydraulic jack plate for a boat and boat motor, the jack plate having a first element attached to the transom of the boat and a second element attached to the motor, the first and second elements of the jack plate slidably engaged through a bolt-in-slot arrangement, the jack plate extendable by activation of a hydraulic cylinder connected between the first and second elements, the apparatus comprising:

a bar having a generally rectangular cross-section, a concave upper end, and a convex lower end, a width of said bar being incrementally smaller than a width of the slot of said bolt-in-slot arrangement of said jack plate, the bar having a length incrementally smaller than a length of the slot of said bolt-in-slot arrangement of said jack plate, such that said bar may be placed within the slot when said jack plate is in an extended position.

2. The apparatus of claim 1 further comprising means for gripping said bar so as to facilitate placement and removal of said bar in said jack plate slot.

3. The apparatus of claim 2 wherein said bar comprises an outward oriented face directed away from said jack plate slot when said bar is positioned in the slot, and wherein said means for gripping comprises a rod extending from said outward oriented face.

4. The apparatus of claim 2 wherein said bar comprises an outward oriented face directed away from said jack plate slot when said bar is positioned in the slot, and wherein said means for gripping comprises a "U"-shaped handle extending from said outward oriented face.

5. The apparatus of claim 2 wherein said means for gripping comprises a flexible cord extending from said bar.

6. The apparatus of claim 2 wherein said means for gripping comprises a length of chain extending from said bar.

7. The apparatus of claim 2 wherein said means for gripping comprises a finger grip section of said bar, said finger grip section defining an aperture in said bar sized to allow insertion of a finger making sufficient frictional contact with an interior wall of said bar to direct the insertion or removal of the bar from the jack plate.

8. The apparatus of claim 1 further comprising a tether extending between said bar and said jack plate to prevent excessive separation of said apparatus from said jack plate.

9. The apparatus of claim 1 further comprising a tether extending between said bar and said boat to prevent excessive separation of said apparatus from said boat.

10. The apparatus of claim 1 wherein said bar comprises a section of machined aluminum rectangular bar stock.

11. The apparatus of claim 1 wherein said bar comprises a high density molded plastic material.

* * * * *